US006752278B2

(12) United States Patent
Craft et al.

(10) Patent No.: US 6,752,278 B2
(45) Date of Patent: Jun. 22, 2004

(54) SPORTS EQUIPMENT STORAGE RACK

(75) Inventors: Charles W. Craft, Apple Creek, OH (US); David M. Stitchick, Wooster, OH (US); Carolee G. Gormley, Medina, OH (US)

(73) Assignee: Rubbermaid Incorporated, Wooster, OH (US)

( * ) Notice: Subject to any disclaimer, the term of this patent is extended or adjusted under 35 U.S.C. 154(b) by 0 days.

(21) Appl. No.: 10/390,208

(22) Filed: Mar. 17, 2003

(65) Prior Publication Data

US 2003/0178383 A1 Sep. 25, 2003

Related U.S. Application Data

(60) Provisional application No. 60/365,677, filed on Mar. 19, 2002.

(51) Int. Cl.[7] ..... A47F 7/00

(52) U.S. Cl. ..... 211/85.7; 211/14; 211/188; 211/60.1; D6/552

(58) Field of Search ..... 211/85.7, 14, 70.6, 211/65, 66, 188, 194, 60.1; D6/552

(56) References Cited

U.S. PATENT DOCUMENTS

D142,352 S * 9/1945 Gutz et al.
2,596,749 A * 5/1952 Webber
2,904,383 A * 9/1959 Potts
3,145,031 A * 8/1964 Wilkinson
3,650,407 A 3/1972 Benham, Jr. ..... 211/14
4,227,710 A * 10/1980 Laub
4,561,547 A 12/1985 Estwanik, III ..... 211/14
4,923,202 A * 5/1990 Breveglieri et al.
5,085,327 A * 2/1992 Mercer et al. ..... 211/14 X
5,722,544 A * 3/1998 Williams ..... 211/188
5,871,105 A 2/1999 Whitehead et al. ..... 211/14
6,079,339 A 6/2000 Houk, Jr. et al. ..... 108/186
6,089,383 A 7/2000 Heneveld ..... 211/14
6,178,896 B1 1/2001 Houk, Jr. et al. ..... 108/186
6,604,473 B2 * 8/2003 Felsenthal ..... 211/187 X
6,666,465 B2 * 12/2003 Chan ..... 211/70.6 X

OTHER PUBLICATIONS

Copy of International Search Report for International Patent Application No. PCT/US03/07871, dated Jun. 30, 2003, 6 pages.

Sky Mall™ CATALOG, "Sports Organizer, Bench Organizer, Golf Organizer/Bench," p. 215.

* cited by examiner

*Primary Examiner*—Robert W Gibson, Jr.
(74) *Attorney, Agent, or Firm*—Marshall, Gerstein & Borun LLP

(57) ABSTRACT

A sports equipment storage rack may include a contained storage area and an upper shelf that is connected to a lower shelf by a plurality of risers and sockets. The upper shelf may include one or more hook/holder portions having at least one slot for resting elongate items and at least one hook for hanging items, and the lower shelf may include one or more retaining portions for securing the elongate items in the slots. The contained storage area is located between the upper and the lower shelf and is capable of storing large and numerous objects.

42 Claims, 7 Drawing Sheets

SPORTS EQUIPMENT STORAGE RACK

RELATED APPLICATION DATA

The present application is a non-provisional application based on co-pending provisional application No. 60/365,677 which was filed on Mar. 19, 2002.

FIELD OF THE DISCLOSURE

The present disclosure relates generally to a storage rack, and more particularly to a free-standing modular sports equipment storage rack.

BACKGROUND OF DISCLOSURE

It is known in the art to provide modular shelving systems or units. One type of modular unit includes a plurality of rectangular panels or shelves, wherein each shelf has four sockets, one provided in each corner of the shelf. Successive shelves may be stacked and interconnected to adjacent shelves by inserting posts or risers into each of the sockets. The modular construction provides flexibility for the consumer to assemble a shelf system or unit with a desired number of shelves and/or a desired height.

In addition, racks and shelving units are known that are specifically designed to hold sporting equipment, such as, for example, basketballs, soccer balls, baseballs, bats, golf clubs, skis, tennis racquets, hockey equipment, and the like. However, known shelving systems or units have not been adequate to provide storage of sporting equipment. For example, the known storage units typically have either planar storage surfaces which does not adequately store and retain many types of sports gear on the surface. Also, such systems have been too expensive to manufacture when providing the necessary space and shape characteristics needed for the proper storage of sporting equipment. Further, current sports equipment racks are limited as to the different types and amounts of sports equipment that may be stored.

Figure 1:
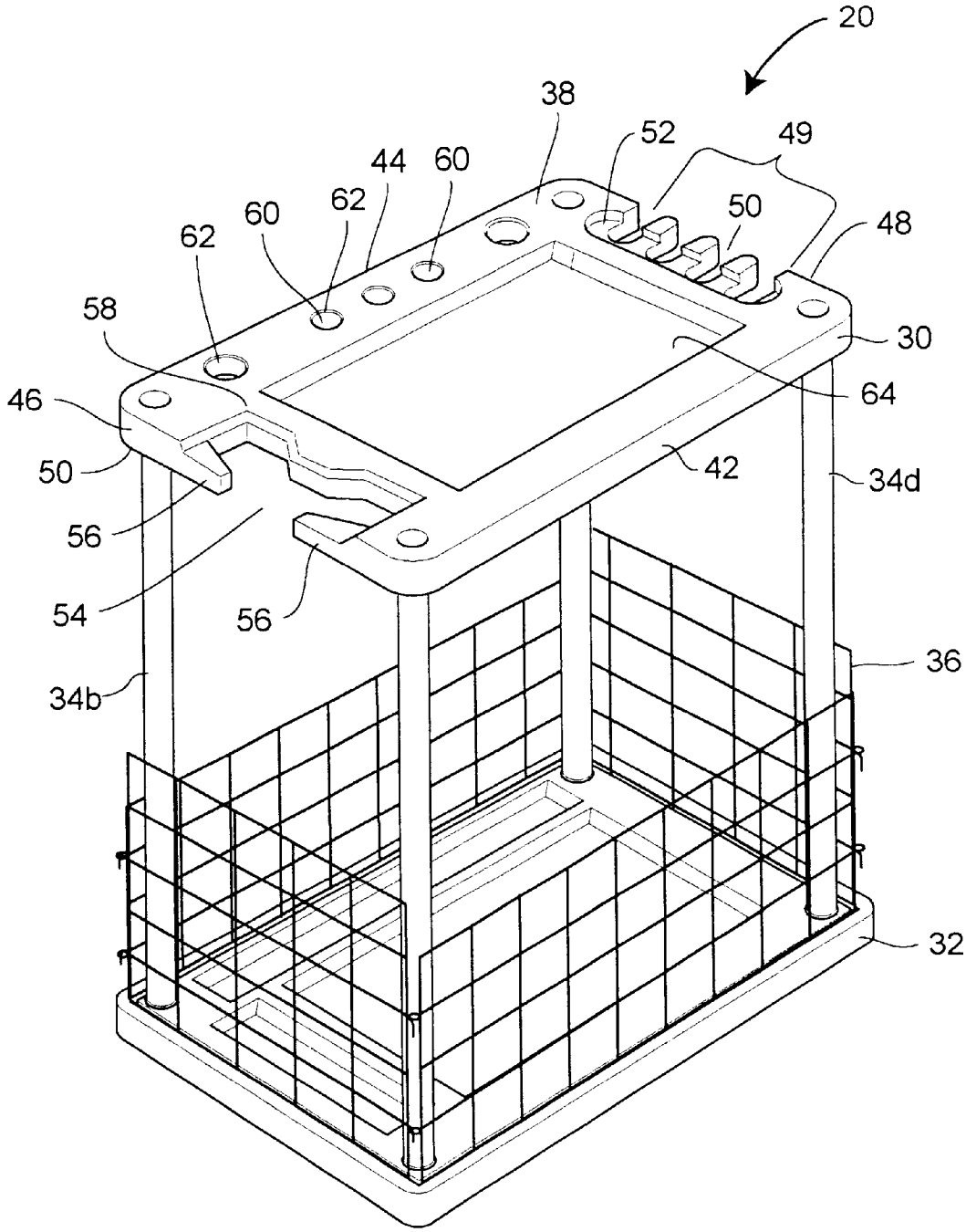
FIG. 1 is a front perspective view of one example of a sports equipment rack constructed in accordance with the present disclosure.

While the disclosure is susceptible to various modifications and alternative constructions, certain illustrative embodiments thereof have been shown in the drawings and will be described in detail below. It should be understood, however, that there is no intention to limit the disclosure to the specific forms disclosed, but on the contrary, the intention is to cover all modifications, alternative constructions, and equivalents falling within the spirit and scope of the disclosure and the appended claims.

DETAILED DESCRIPTION

In accordance with one aspect of the disclosure, a sports equipment storage rack including an upper shelf, a lower shelf, one or more risers, and a contained storage area is disclosed. The upper shelf may include sockets and one or more hook/holder portions having at least one slot and at least one hook for resting and hanging items. The lower shelf may include sockets and one or more receiving areas for securing the items located in the slots. The upper shelf and the lower shelf are connected by one or more risers which may be adapted to engage with the sockets of the upper shelf and the lower shelf, and the contained storage area may be located between the upper and the lower shelf for the general storage of items.

Figure 4:
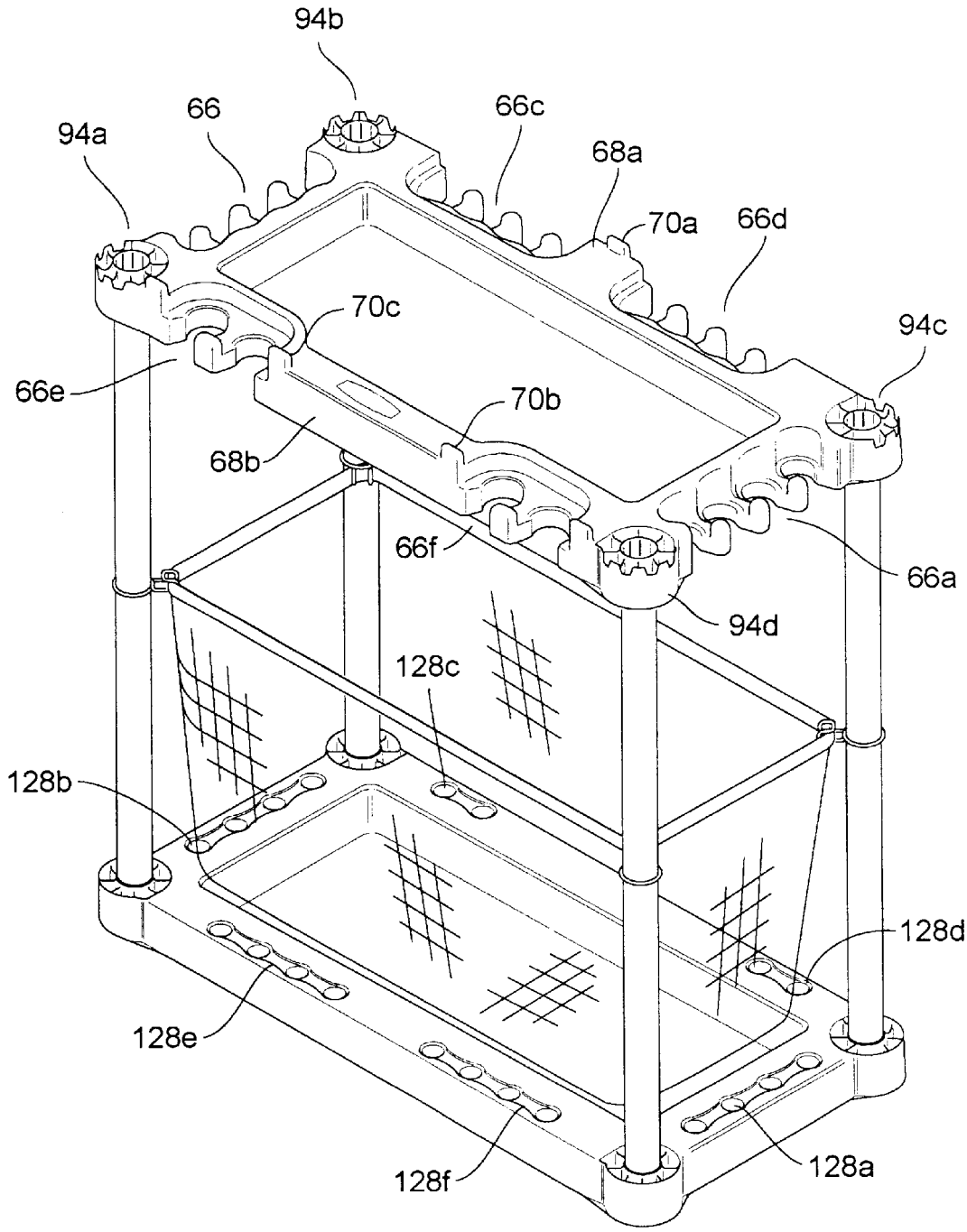
FIG. 4 is a front perspective view of another example of a sports equipment storage rack constructed in accordance with the present disclosure.

Referring now to the drawings, and with specific reference to FIGS. 1 and 4, a sports equipment rack in accordance with the teachings of the disclosure is indicated generally at reference numeral 20. As shown therein, the sports equipment rack 20 includes an upper shelf 30, a lower shelf 32, a plurality of risers 34, and a contained storage area 36. The risers will herein be referenced and described in general as risers 34, and when referring to a particular one of the risers, as a riser 34*a*, 34*b*, 34*c*, or 34*d*.

The sports equipment rack 20 will be hereinafter described as having a generally rectangular shape in plan view, wherein the upper rectangular shelf 30 is supported by a set of four risers 34*a*, 34*b*, 34*c*, and 34*d* and wherein the risers 34*a*, 34*b*, 34*c*, and 34*d* are disposed between the rectangular lower shelf 32 and the upper rectangular shelf 30. The contained storage area 36 may be adapted to fit the overall shape of the sports equipment rack, and may be adapted to fit within or outside the risers 34.

The generally rectangular shape of the sports equipment rack 20 is only one of many possible examples. The sports equipment rack 20 may take on other shapes including, but not limited to, round, square, oval, or triangular. Similarly, the number of sides the contained storage area 36 can have and may also change to accommodate the different shapes. The contained storage area 36 may, for example, have only one side to accommodate a round shape or may have six sides to accommodate a hexagonally shaped sports equipment rack 20. Furthermore, each side of the contained storage area 36 may be constructed of several pieces such that, for example, a contained storage area 36 having a round shape may be constructed of more than one piece. Examples of various contained storage area 36 constructions are enclosed herein.

The rectangular lower shelf 32, the risers 34, the upper rectangular shelf 30, and the contained storage area 36 may be fabricated from relatively light weight, durable and sturdy plastic materials such as polyethylene, polypropylene, polystyrene, or other suitable plastic materials. The process or processes used to form the various components of the disclosed sports equipment rack 20 can also vary considerably as necessary to form each given component. The various components of the sports equipment rack 20 may be injection molded, blow molded, continuously molded, extruded, vacuum formed, rotation molded, or the like. The manufacturing process or processes can be selected based on feasibility, cost, tooling concerns, as well as other factors for a given application. The sports equipment rack 20 may also be molded or constructed utilizing other suitable molding processes or construction methods.

Figure 2:
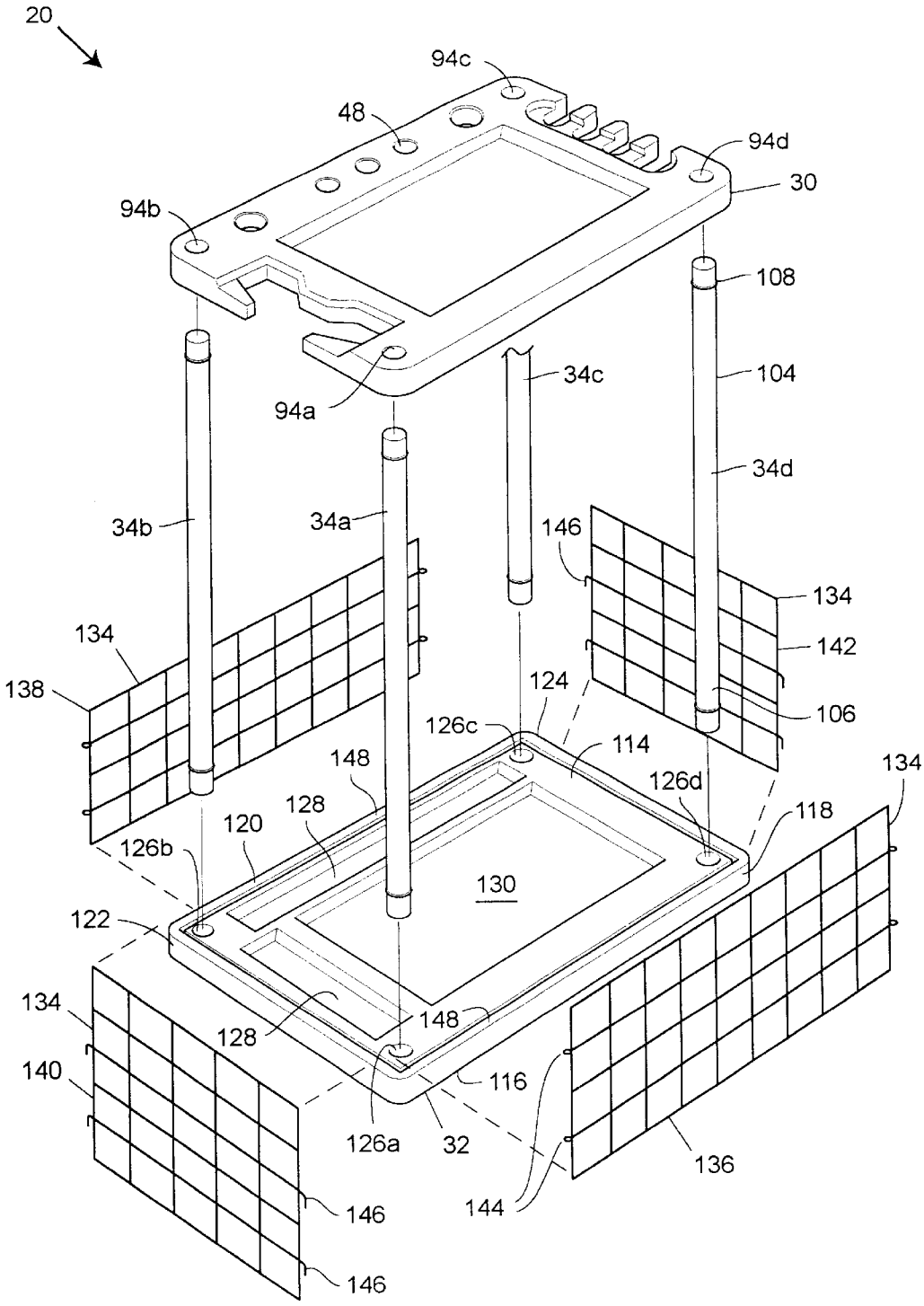
FIG. 2 is an exploded front perspective view of the sports equipment rack of FIG. 1.
Figure 3:
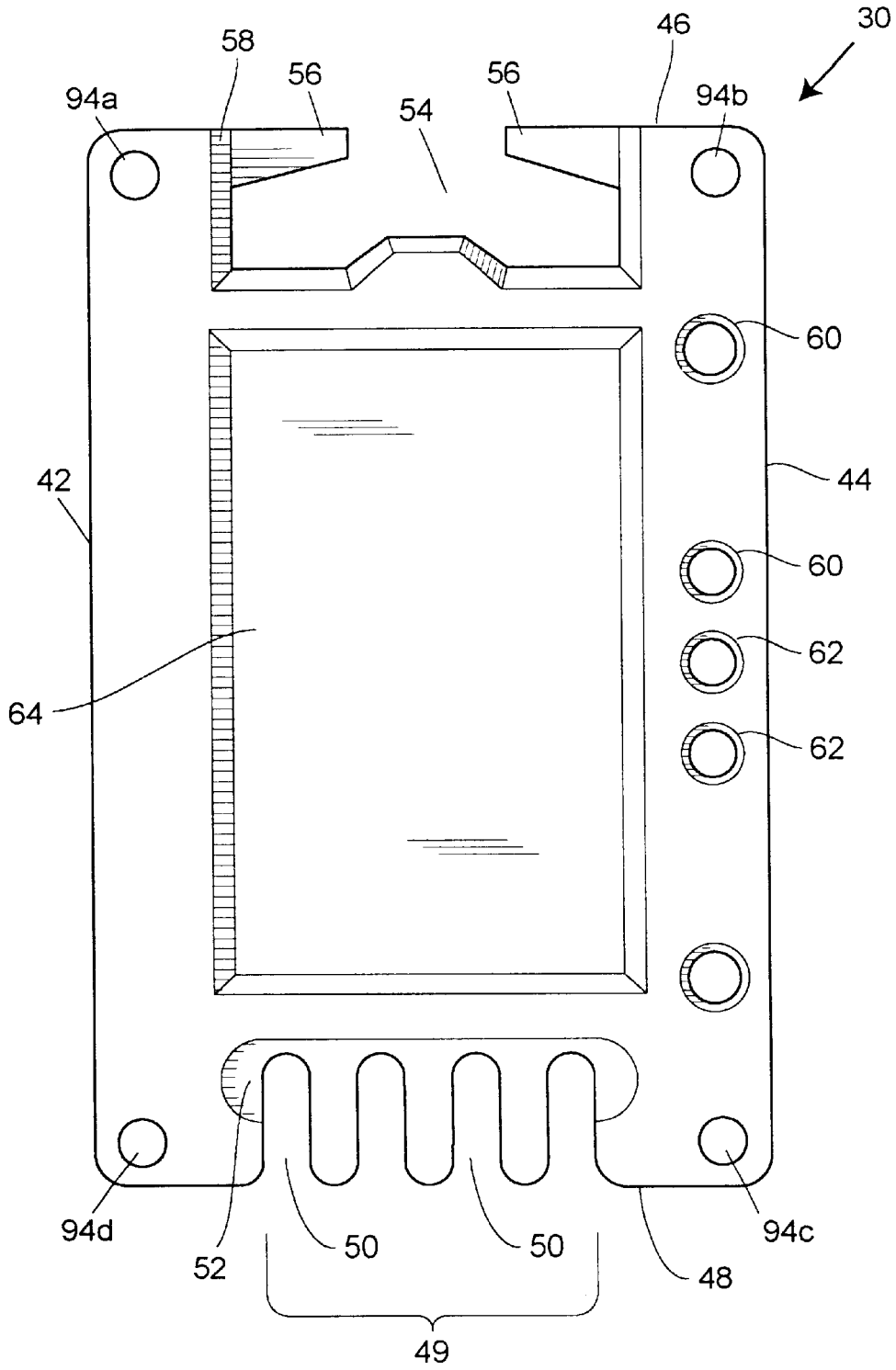
FIG. 3 is a plan view of an upper shelf of the sports equipment rack of FIG. 1.

The upper rectangular shelf 30, as shown in FIGS. 1, 2, and 3 may have a top 38, a bottom 50, a front 42, a rear 44, a left side 46, and a right side 48. The top 38 and the bottom 40, the right side 48 and the left side 46, and the front 42 and the rear 44, may all be respectively generally parallel to each other.

In one exemplary embodiment, a hook/holder portion 49 having a plurality of slots 50 may be located near the right side 48 of the upper shelf 30, extending the entire height of the upper shelf 30. The term "hook/holder portion" as used herein refers to a portion of the sports equipment rack 20 having at least one slot in which a piece of sporting equipment may be securely hung or rested. The slots 50 may be open to the right side 48 of the upper shelf 30 to allow the placement of elongate items such as baseball and softball bats into the slots 50. The hook/holder portion 49 may also include a cavity 52 to secure the elongate items in combination with the slots 50. The elongate items, such as baseball or softball bats for example, may be placed into the slots 50 such that the tops of the bats are facing downward and the handles of the bats are being received in the slots 50. The bottom of the bats, having a knob, may then be placed into the cavity 52, thereby preventing the bats from sliding or otherwise becoming dislodged from the slots 50.

One or more openings 54 may be on the left side 46 of the upper shelf 30, adapted to retain or hold items having a height larger than that of the risers 34 such as skis and golf clubs. More specifically, the opening 54 may be wider than the individual slots 50, and may be open to the left side 46 of the upper rectangular shelf 30 and may be large enough, such that the sports equipment can be slid into the opening 54. In combination with the opening 54, the upper rectangular shelf 30 may include a retention means 56 to retain the sports equipment in the opening 54. The retention means 56 may, for example, be a pair of protrusions extending toward the middle of the opening 54 stemming from the either side of the opening 54. The retention means 56 may, however, be a single protrusion, a bungee cord, a flexible piece or any other suitable means to prevent the sports equipment from falling out of the opening 54. The opening 54 may also include a chamfered upper edge 58 along the perimeter of the opening 54, thereby preventing items retained in the opening 54 from coming in contact with a sharp corner.

A plurality of apertures 60 may be located within the upper shelf 30, near the rear 44, and adapted to hold or receive various types of sports equipment including, but not limited to, tennis racquets, hockey sticks, golf umbrellas, and the like. The apertures 60 may also include a chamfered upper edge 62 to provide a more secure and less damaging environment for the sports equipment. There may also be an upper recessed area 64 located on the top 38 of the upper shelf 30, thereby allowing any objects or sports equipment such as gloves and/or helmets to be placed therein.

In another exemplary embodiment, as seen in FIGS. 4–9, the upper rectangular shelf 30 may include one or more hook/holder portions 66, one or more spacer portions 68, and one or more retaining bumps 70.

Figure 5:
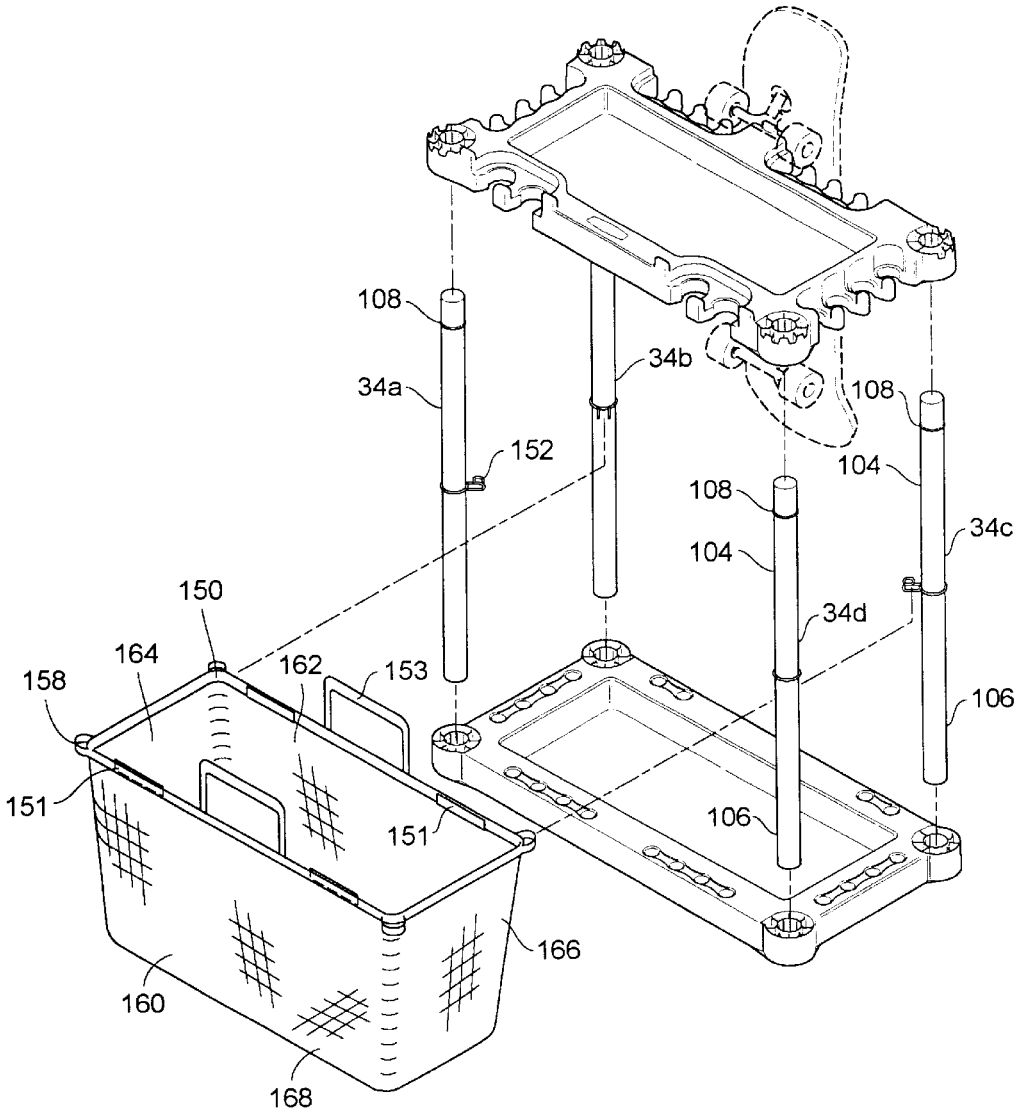
FIG. 5 is an exploded front perspective view of the sports equipment rack of FIG. 4.

A hook/holder portion 66*a*, as shown in FIGS. 4 and 5, may be located near the right side 48 of the upper shelf 30. The hook/holder portions 66 (FIGS. 7 and 9), the spacer portions 68 (FIG. 10), and the retaining bumps 70 will herein be used, references and described in detail as being an entity representative of similar or identical hook/holder portions 66, spacer portions 68, or retaining bumps 70, respectively. The hook/holder portions 66 may include one or more slots 50, a cavity 52, one or more cupped recesses 72, and one or more hooks 74. The slots 50 may extend the entire height of the upper rectangular shelf 30 and may be open to the outside of the upper shelf 30, to allow the placement of elongate items such as baseball bats, tennis rackets, hockey sticks, or the like, into the slots 50. The cavity 52 may be a void in the upper part of the upper shelf 30, and may be an area encompassing the slots 50.

Figure 9:
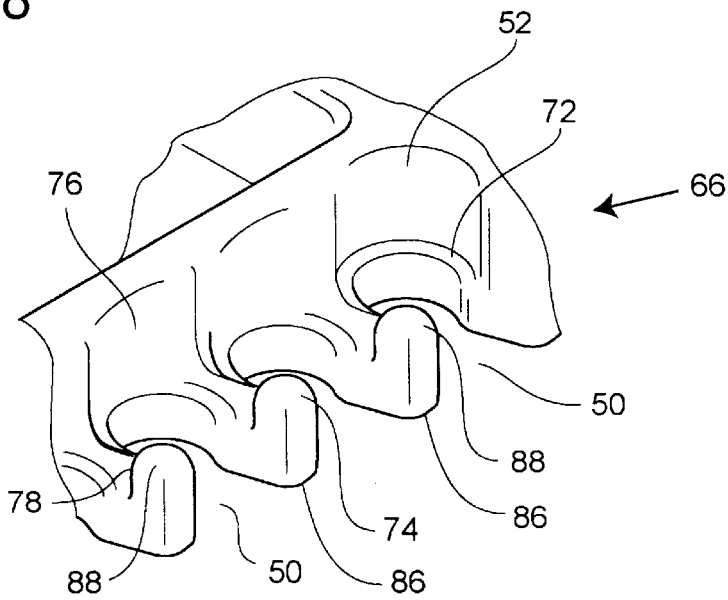
FIG. 9 is a detailed perspective view of a hook/holder portion of FIG. 4.
Figure 10:
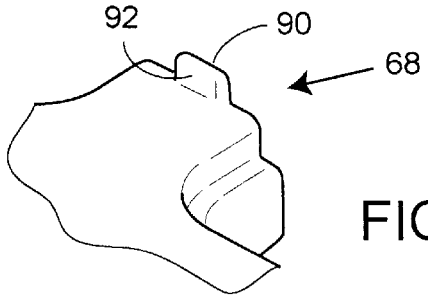
FIG. 10 is a perspective view of a spacer portion on the upper shelf of the sports equipment rack of FIG. 4.

More specifically, as shown in FIG. 9, the cavity 52 may include an inner wall 76, an outer wall 78, a first side wall 80, a second side wall 82, and a base 84. The inner wall 76 creates the rear boundary of the cavity 52 and is located between the slots 50 and the upper recessed area 64. The first and second side walls 80, 82 are located to the respective sides of the slots 50 and create the side boundaries of the cavity 52. The outer wall 78 is located between the outer perimeter of the upper rectangular shelf 30 and the inner wall 76, and creates the outer boundary of the cavity 52 and, optionally, defines the inside portion of the hooks 74. The hooks 74 may be located on intermediate portions 86 of the slots 50, and more specifically, may be vertically extending knobs 88 located at the ends of the intermediate portions 86 that are adapted to retain sports equipment in the slots 50 and/or adapted to hang sports equipment.

The cupped recesses 72 may be located around the perimeter of the slots 50, between the bottom 40 of the upper rectangular shelf 30 and the cavity 52, and adapted to secure the elongate items in combination with the slots 50. The elongate items, such as baseball or softball bats for example, may be placed into the slots 50, such that the tops of the bats are facing downward and the handles of the bats are being received in the slots 50. The bottom of the bats, having a knob, may then be placed into the cupped recesses 72, thereby preventing the bats from sliding or otherwise becoming dislodged from the slots 50. A second hook/holder portion 66*b* may be located near the left side 46 of the upper shelf 30.

A third hook/holder portion 66*c*, a fourth hook/holder portion 66*d*, and a first spacer portion 68*a* may be located near the rear 44 of the upper shelf 30. The spacer portion 68*a*, located near the center of the rear 44 of the upper shelf 30, connects the third and fourth hook/holder portions 66*c*, 66*d* and may include a first retaining bump 70*a*. A retaining bump 70 (FIG. 1O), as used herein, may be of a general rectangular shape including a front 90 and a rear 92, and may be located toward the outer edge of the spacer portions 68, such that the front of the bump 70 is substantially flush with the outer edge of the upper rectangular shelf 30 and the rear 92 of the bump 70 is parallel to the front 90 of the bump 70. The bump 70 may be utilized to store various types of sport equipment, such as for example, bags having straps, helmets, or any other type of sports equipment that may be hung on the bump 70. Furthermore, the bump 70 may be used to store sports equipment that is not traditionally hung, such as skateboards. More specifically, a skateboard (as shown on FIG. 5) may be vertically hung on the bump 70 by placing a rear portion of an upper axle of the skateboard against the rear 92 of the bump 70 such that a platform of the skateboard faces away from the bump 70.

A fifth hook/holder portion 66*e*, a sixth hook/holder portion 66*f*, and a second spacer portion 68*b* may be located to the front 42 of the upper shelf 30. The spacer portion 68*b*, located near the center of the front 42 of the upper shelf 30, connects the fifth and sixth hook/holder portions 66*e*, 66*f* and includes one or more retaining bumps 70 in this example. The spacer portion 68*b* also includes a retaining bump 70*b* located toward the hook/holder portion 66*f*, and a retaining bump 70*c* located toward the hook/holder portion 66*e* in this example.

In one exemplary embodiment (FIGS. 4 and 5), sockets 94, and more specifically, four sockets 94*a*, 94*b*, 94*c*, and 94*d*, may be located near each of the four corners of the upper shelf 30, and adapted to receive corresponding risers 34*a*, 34*b*, 34*c*, and 34*d*. The sockets will herein be referenced and described in general as sockets 94, and when referring to a particular one of the sockets, as a socket 94*a*, 94*b*, 94*c*, or 94*d*. The sockets 94 may simply consist of circular apertures, but may include more complex structures to engage with structural features of the risers 34. The sockets 94 can be adapted to receive risers 34 on the top 38 of the upper shelf 30, and on the bottom 40 of the upper shelf 30, thereby creating a modular unit to be combinable with other like units. Each of the sockets 94 may be configured in a manner similar to that shown and described in U.S. Pat. No. 6,178,896. However, other configurations are certainly possible and may be used in practicing the invention.

Figure 8:
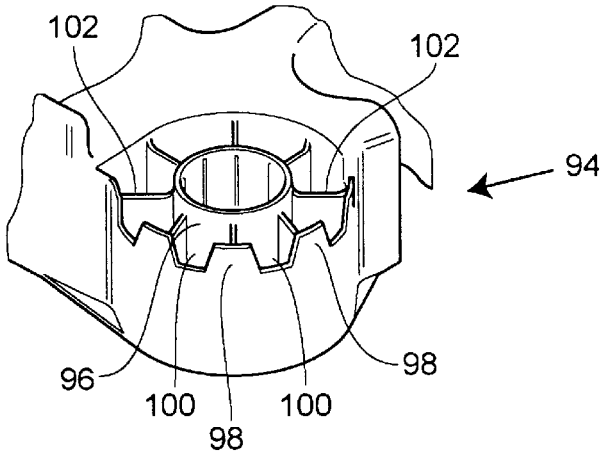
FIG. 8 is a perspective view of a crown feature on the upper shelf of the sports equipment rack of FIG. 4.

In another exemplary embodiment, as seen in FIG. 8, one or more serrated or crown shaped features 96 may be located near the four corners of the upper rectangular shelf 30 and adapted to retain a variety of sports equipment. More specifically, a crown shaped feature 96 may be defined on an outer, upper surface of the sockets 94, and/or may be defined on an outer, upper surface of the upper shelf 30. The serrated or crown shaped features 96 includes one or more vertically extending tabs 98, and/or one or more slots 100 in the illustrated example. The tabs 98 and slots 100 alternate in a radial direction around the sockets 94 and can be designed in height and width to facilitate the hanging of sports equipment on the tabs 98. The crown shaped feature 96 may further include one or more support ribs 102, which may be an integral part of the socket 94. More specifically, the support ribs 102 extending from the socket 94 may connect to a rear of the tabs 98, thereby providing support and stability to the tabs 98 as well as to the socket structure.

In one exemplary embodiment, as shown in FIGS. 2 and 5, the risers 34 have a generally cylindrical shape and may each include a first end 104 and a second end 106. Either one or both ends 104 and 106 of the risers 34 may be designed and adapted with specific structural features and characteristics that mate with corresponding features and characteristics of the sockets 94. Alternatively, one or both ends 104 and 106 of the risers 34 may simply be a circular cylinder of the same or a reduced diameter relative to the diameter of the exterior surface of the riser 34. More specifically, the outer diameter of the ends of the risers 34 may have a reduced diameter, such that substantially the entire reduced outer diameter is able to engage with the inside diameter of the sockets 94. Furthermore, the transition from the reduced outer diameter of the ends of the risers 34 to the full diameter of the risers 34 may include a ridge 108 that can both prevent the risers 34 from further insertion into the sockets 94, and/or provide for a means to translate the forces and weight of the upper rectangular shelf 30 into the risers 34, and hence into the lower shelf 32. The first and second ends 104 and 106 of the risers 34 may be different, and may be adapted to engage with either the upper rectangular shelf 30 or the lower shelf 32. If desired, the first and second ends 104 and 106 of the risers 34 may be similar or substantially identical to one another, thereby allowing the ends of the risers 34 to be interchangeable with any shelf and any socket.

Figure 6:
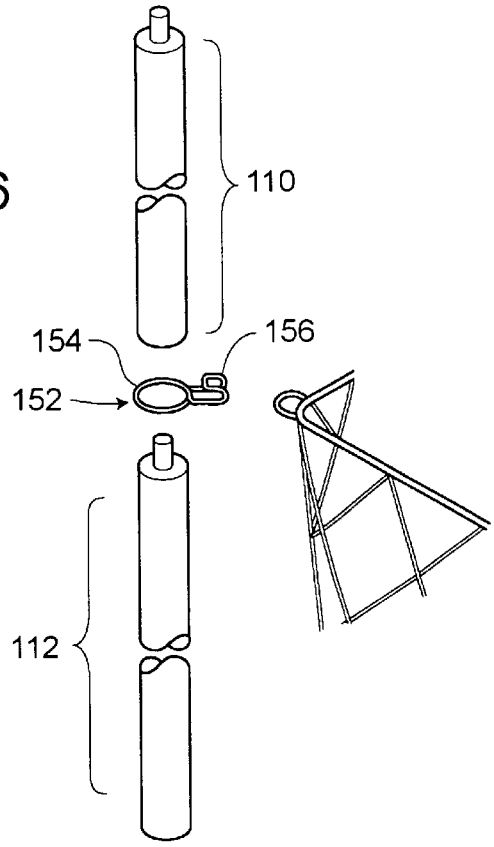
FIG. 6 is a partial exploded perspective view of one example of a riser, a hook, and contained storage area of the sports equipment rack of FIG. 4.
Figure 6:
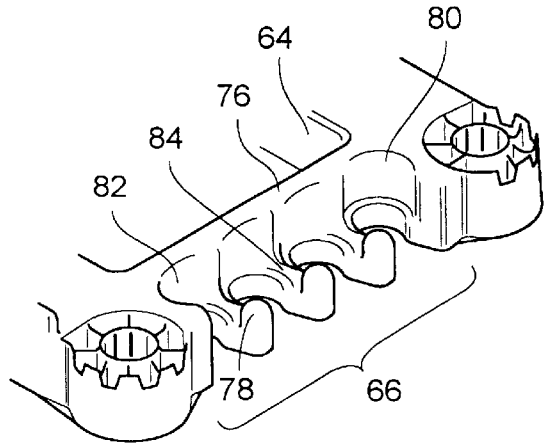
Figure 7:
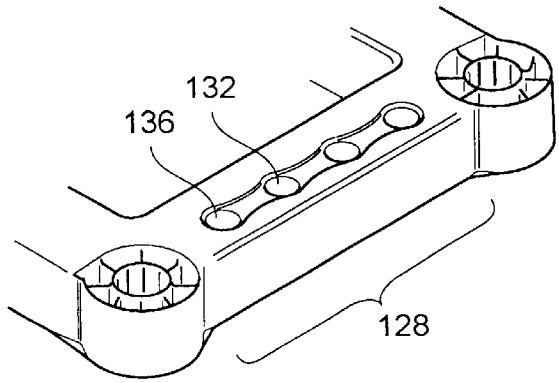
FIG. 7 is a perspective view of a hook/holder portion on the upper shelf and a retaining portion on the lower shelf of the sports equipment rack of FIG. 4.

The risers 34 may consist of one or more pieces, as shown in FIG. 6. The riser 34 may include a first riser piece 110, having a reduced diameter on one end and a full diameter on the other end, and a second riser piece 112, having a reduced diameter on one end and a full diameter on the other end. In the illustrated example, the reduced diameter of the second riser piece 112 is placed within the full diameter end of the first riser piece 110, thereby forming the riser 34.

In one exemplary embodiment, a seen in FIG. 2, the rectangular lower shelf 32 may be similar in shape and size as the upper shelf 30 and, therefore, also may be substantially rectangular in shape, having a top 114, a bottom 116, a front 118, a rear 120, a left side 122, and a right side 124. The top 114 and bottom 116, the right side 124 and left side 122, and the front 118 and rear 120, may all be generally parallel to each other, respectively.

A socket 126 adapted to receive the risers 34 may be located near each of the four corners of the rectangular lower shelf 32. More specifically, the rectangular lower shelf 32 may include sockets 126*a*, 126*b*, 126*c*, and 126*d*, which are adapted to receive the risers 34*a*, 34*b*, 34*c*, and 34*d*, respectively. The sockets 94*a*, 94*b*, 94*c*, and 94*d* may be structurally similar or identical to the sockets 126*a*, 126*b*, 126*c*, and 126*d*. The sockets will herein be referenced and described in general as sockets 126, and when referring to a particular one of the sockets, as a socket 126*a*, 126*b*, 126*c*, or 126*d*.

A series or plurality of retaining portions 128 may be located on the top 114 of the rectangular lower shelf 32. For example, there may be one or more retaining portions 128 located near the rear 120 of the rectangular lower shelf 32 adapted to receive and/or secure sports equipment placed in the apertures 60 of the upper rectangular shelf 30 above. A hockey stick, for example, that is placed in an aperture 60, such that the butt end of the hockey stick is brought through the aperture 60 and then rested on the top 114 of the rectangular lower shelf 32, may then rest in the retaining portions 128 to eliminate sliding or other movement of the hockey stick on the top 114 of the rectangular lower shelf 32. Similarly, another retaining portion 128 may be located near the left side 122 of the rectangular lower shelf 32 and adapted to receive or secure sports equipment placed in the opening 54 of the upper rectangular shelf 30 above. A set of skis, for example, can be placed in the opening 54, such that the tails of the skis rest on top 114 of the rectangular lower shelf 32 and that the center portion of the skis rest against the upper shelf 30. The retaining portions 128 eliminate sliding or other movement of the skis on the top 114 of the rectangular lower shelf 32. There may also be a lower recessed area 130 located on the top 114 of the rectangular lower shelf 32, thereby allowing any objects or sports equipment such as balls, gloves and/or helmets to be placed therein.

In another exemplary embodiment, a series or plurality of retaining areas 128 may be located on the top 114 of the lower shelf 32 and adapted to retain sports equipment. More specifically, a retaining area 128 can be aligned with the hook/holder portions 66. The retaining portions 128 may include one or more indentations 132. The retaining portions 128 may be a generally recessed area within the lower shelf 32, aligned with a hook/holder portions 66 and adapted to serve as a retaining portion 128 for elongate items in the slots 50. The indentations 132 may be a circular recessed area within the retaining portion 128, axially aligned with the slots 50 and adapted to also serve as retaining portions for elongate items in the slots 50. For example, there may be one or more retaining portions 128 with one or more indentations 132 wherein the retaining portions 128 are aligned to the hook/holder portions 66, and adapted to receive and/or secure sports equipment placed in the hook/holder portions 66 of the upper rectangular shelf 30 above.

A hockey stick, for example, can be placed in a hook/holder portion 66, such that the butt end of the hockey stick is brought through the slots 50 and then rested on the top 114 of the lower shelf 32. The hockey stick will then rest in a retaining portion 128 and in an indentation 132 to eliminate sliding or other movement of the hockey stick on the top 114 of the lower shelf 32. Retaining portions 128 having indentations 132 may be located relative to each hook/holder portion 66. More specifically, retaining portions 128*a–f* may each be aligned with a corresponding first through sixth hook/holder portions 66*a–f*, respectively.

The lower recessed area may be located in the center of the top 114 of the lower shelf 32, thereby allowing any objects or sports equipment such as balls, gloves and/or helmets to be placed therein.

In one exemplary embodiment as shown in FIGS. 1 and 2, the contained storage area 36 is a cage 134 having four generally vertically oriented panels. The sport equipment rack 20 has a rectangular shape and includes a front panel 136, a rear panel 138, a left side panel 140, and a right side panel 142 of the cage 134. The front panel 136 and the rear panel 138, and left side panel 140 and right side panel 142, respectively, may have substantially equal lengths as shown in the illustrated example, though the panels need not be so constructed.

The panels 136, 138, 140, and 142 of the general storage are 36 may be constructed of similar or the same material as the rectangular lower shelf 32 and upper shelf 30, and may be constructed from any suitable material including, but not limited to, wood, metal, plastic, and the like. The panel material may also be perforated, ranging from small to large holes, or may be constructed from wire mesh or the like, therewith creating fence or grid like panel structures. The front and/or the rear panels 136 and 138 may also be of a different length and/or height than one another or than the left and/or the right side panels 140 and 142.

The panels 136, 138, 140, and 142 may also be interlocking, such that no external devices or objects are required to engage the different panels of the contained storage area 36 with one another. For example, the front and rear panels 136 and 138 can include one or more loops 144 disposed at the respective ends or edges of the panels 136 and 138. The loops 144 may be created from the same material as the panels 136, 138, 140, and 142 and are preferably oriented such that the open ends of the loops face in a vertical direction, thereby being adapted to receive hooks 146. The left and right side panels 140 and 142 may have one or more complimentary hooks 146 disposed at the respective ends or edges of the side panels 140 and 142. The hooks 146 may also be created from the same material as the sides 140 and 142 and are preferably oriented such that the ends of the hooks 146 face downward.

The hook and loop arrangement is one of many alternative means of creating interconnecting panels of a cage type storage area 36. As is known in the art, there are many other ways that can be used for interconnecting the panels together. Similarly, the means for connecting the panels may also be accomplished using external devices, such as, for example, bungee cords, zip ties, cable ties, rubber bands, rope, clamps, VELCRO®, and the like. The panels, for example, may be individually fastened to the risers such that the right side panel 142 is fastened to the risers 34*c* and 34*d*, the rear panel 138 is fastened to the risers 34*b* and 34*c*, the left side panel 140 is fastened to the risers 34*a* and 34*b*, and the front panel 136 is fastened to the risers 34*a* and 34*d*. Alternatively, the panels 136, 138, 140, and 142, may be bungeed together, such that one or more large bungee cords are placed to the exterior of the panels 136, 138, 140, and 142, thereby forcing the sides 136, 138, 140, and 142 against their respective risers. Alternatively, the sides may be connected to each other by external devices (not shown), as mentioned above with or without being fastened to the risers 34. It is also contemplated that the contained storage area 36 may be comprised of one or more panels, in ways other than previously described. For example, the contained storage area 36 may be a single unitary piece located between the upper and lower shelves 30, 32. In one embodiment, the contained storage are 36 may comprise of a continuous unbroken material adapted to circumvent the risers 34. In this embodiment, the user may dispose the contained storage area 36 around the risers 34 prior to installation of the upper shelf 30 onto the risers 34. In another embodiment, the contained storage area 36 may be comprised of a single piece adapted to secure to itself or adapted to be secured by a securing mechanism. In this embodiment, the user may dispose the contained storage area 36 around the risers 34 anytime during construction of the sports equipment rack 20.

In one example, the panels 136, 138, 140, and 142 may be placed around the exterior of the sports equipment rack 20, bound by the four risers 34*a*, 34*b*, 34*c*, and 34*d*, such that the interior of the panels abut the risers 34*a*, 34*b*, 34*c*, and 34*d*, and the exterior of the sides face outward away from the risers 34*a*, 34*b*, 34*c*, and 34*d*. A ridge or groove 148 may also be located on the upper perimeter of the rectangular lower shelf 32, wherein the ridge or groove 148 is adapted to engage with the panels 136, 138, 140, and 142. More specifically, the ridge or groove 148 may be positioned and configured such that the bottom ends or edges of the panels 136, 138, 140, and 142, can rest in the ridge or groove 148 when the panels 136, 138, 140, and 142 are interconnected together. The interconnection of the panels 136, 138, 140, and 142 may be accomplished by abutting the interior of the front panel 136 against the risers 34*a* and 34*b*, and abutting the interior of the rear panel 138 against the risers 34*b* and 34*c*, such that one or more loops 144 on each edge of the panels 136 and 138 protrude past the risers 34*a*, 34*b*, 34*c*, and 34*d*. The left and right panels 140 and 142 may then be placed into position, such that the interior of the left side panel 140 abuts the risers 34*a* and 34*b*, and that the interior of the right side panel 142 abuts the risers 34*c* and 34*d*. To engage the hooks 146 and the loops 144, the bottom edges of the left and right side panels 140 and 142 may be guided toward the ridge or groove 148, such that one or more hooks 146 on each of ends of the left and right side panels 140 and 142 are engaged with the loops 144, thereby interconnecting side panels 140 and 142 to front and rear panels 136 and 138. The bottom edges of the left and right side panels 140 and 142 may also rest on the ridge or groove 148.

In another exemplary embodiment shown in FIGS. 5 and 6, the contained storage area 36 may alternatively be formed as a bag 150 with one or more retainers 152. The retainers 152 may be attached to any part of the sports equipment rack 20. In one example, the retainers 152 may be attached to or engaged with the risers 34. In one exemplary embodiment, the retainers 152 have a circular ring 154 and a hook 156 extending from the ring. The ring 154 may be slipped over the risers at a joint between the first and second riser portions 110, 112, thereby securing the hooks 156 onto the risers 34. The hook 156 may be fixedly attached to the ring 154, such that the retainers are captured between riser portions to secure and support a part of the bag 150.

The bag 150 may include a plurality of pieces, a closing mechanism 151, a handle 153, and a plurality of loops 158. More specifically, in the exemplary embodiment, when the sport equipment rack 20 has a rectangular shape, the bag 150 may be complimentary in shape and include a front side 160, a rear side 162, a left side 164, a right side 166, and a bottom portion 168. The front side 160 and rear side 162, and the left side 164 and right side 166, respectively, may have substantially equal lengths. The pieces 160, 162, 164, 166, and 168 of the bag 150 may be constructed from any suitable fabric or other flexible or pliable material intended for the purpose including, but not limited to, cotton, plastic, nylon, or the like. The material may also be perforated, ranging from small to large holes, such as a fabric mesh to permit air flow through the bag. The loops 158 may be apertures in the bag 150, such as for example, a hole or a slot, and may be reinforced with material added to the bag 150. For example, the loops 158 may include additional material attached to the top perimeter of the bag 150 and/or include a metal ring, grommet, or the like to reinforce the structure of the loops 150.

A closing mechanism 151 may be adapted to close the bag 150 while still attached to the sports equipment rack 20, and/or adapted to close the bag 150 when removed from the sports equipment rack 20. For example, the closing mechanism 151 may be a fastening system such as snaps, a zipper, VELCRO®, a pull cord, or the like. The closing mechanism 151 can also utilize a cover or lid to close the bag 150. The closing mechanism 151 may, however, include any type of fastening system able to close the bag 150, and the various parts of the fastening system may be provided along the entire top perimeter or located on the upper edges of one or more of the sides 160, 162, 164, and 166 to connect the top of the sides together, thereby closing the bag 150.

The handle 153 may have one or more parts, which may be located on one or more sides of the bag 150. The handle 153 may, for example, be attached to the top of two parallel sides of the bag 150, thereby enabling the user to lift or pull the bag 150 from the hooks 152, and/or to carry the bag 150 when removed the sports equipment rack 20.

In operation, the sports equipment rack 20 may be purchased as a ready-to-assemble system, so that the cost of packaging and transportation is minimized due to the compact size. The lack of need for tools to assemble the rack 20 permit such unassembled packaging. To assemble the rack 20, the user, after unpacking the parts, may proceed to push one end of the risers 34*a*, 34*b*, 34*c*, and 34*d* into the sockets 126*a*, 126*b*, 126*c*, and 126*d*, located on the rectangular lower shelf 32, such that the risers 34*a*, 34*b*, 34*c*, and 34*d* are fully engaged with sockets 126*a*, 126*b*, 126*c*, and 126*d*. Placing the assembly with the bottom 116 of the rectangular lower shelf 32 on the ground, the user may proceed to push the sockets 94*a*, 94*b*, 94*c*, and 94*d* located on the bottom 40 of the upper shelf 30, onto the other side of the risers 34*a*, 34*b*, 34*c*, and 34*d*, until the risers 34*a*, 34*b*, 34*c*, and 34*d* are fully engaged with the sockets 94*a*, 94*b*, 94*c*, and 94*d*.

In one embodiment, as shown in FIGS. 1 and 2, the cage 134 may be assembled by placing the interior of the front side 136 against risers 34*a* and 34*d*, and placing the interior of the rear side 38 against risers 34*b* and 34*c*, such that one or more loops 144 on each ends of the sides 136 and 138 protrudes past the risers 34*a*, 34*b*, 34*c*, and 34*d*. The left and right sides 140 and 142 may now be placed into position, such that the interior of the left side 140 contacts risers 34*a* and 34*b*, and that the interior of the right side 142 contacts risers 34*c* and 34*d*. To connect the hooks 146 and loops 144, the bottoms of the left and right sides 140 and 142 may be guided toward the ridge or groove 148, such that one or more hooks 146 on each of the ends of the left and right sides 140 and 142 are placed into the loops 144, thereby interconnecting the sides 136, 138, 140, and 142.

In another exemplary embodiment, as shown in FIGS. 4 and 6, the bag 150 is hung within the sport equipment rack 20. In the exemplary embodiment where the risers 34 include two pieces 110, 112, the user may insert the retainers 152 between the two riser pieces 110, 112. More specifically, the user may position the rings 154 between the riser portions 110, 112, and slip the rings 154 over the reduced diameter of the riser portion 112. The fill diameter of the riser portion 110 is then placed onto the riser portion 112, thereby trapping or capturing the ring 154 of the retainer 152 in the risers 34. In another exemplary embodiment, the retainers 152 may be attached to the risers 34 by a fastener, or the retainers 152 or discrete hooks 156 may be adapted to engage with the risers 34 directly. For example, the hooks 156 may be attached to the risers 34 via a screw, or the like, or the risers 34 may include a groove (not shown) in which the rings 154 may rest. Once the retainers 152 are installed in the sports equipment rack 20, the user may place the loops 158 of the bag 150 onto the hooks 156.

After assembly, the sports equipment rack 20 may be utilized as an individual unit, or may combined with other units to create a larger storage unit. When being utilized as an individual unit, the user may place different types of sports equipment into and onto the various storage areas within the sports equipment rack 20, including the contained storage area 36, whether the cage 134 or the bag 150, at the bottom of the sports equipment rack 20. In another exemplary embodiment, the user may remove the bag 150 from the sport equipment rack 20 and transport the sport equipment located therein.

The foregoing detailed description has been given for clearness of understanding only and no unnecessary limitations should be understood therefrom, as modifications will be obvious to those skilled in the art.

What is claimed is:

1. A sports equipment storage rack comprising:

an upper shelf including, one or more hook/holder portions having at least one slot for resting elongate items and at least one hook for hanging items, and a plurality of sockets;

a lower shelf including, one or more retaining portions for securing the elongate items in the slots and a plurality of sockets;

a plurality of risers having a first and a second end, wherein the risers connect the upper shelf and the lower shelf; and a contained storage area located between the upper and the lower shelf capable of storing large and numerous objects.

2. The sports equipment storage rack of claim 1 wherein one or more of the components are manufactured from one of a polyethylene, polypropylene, and polystyrene material.

3. The sports equipment storage rack of claim 1 wherein the one or more hook/holder portions include a cavity thereby creating at least a portion of the at least one hook.

4. The sports equipment storage rack of claim 1 wherein the one or more hook/holder portions include at least one cupped recess.

5. The sports equipment storage rack of claim 1 wherein the upper shelf includes a recessed area for placing items therein.

6. The sports equipment storage rack of claim 1 wherein the upper shelf includes one or more retaining bumps projecting upward from a surface of the upper shelf.

7. The sports equipment storage rack of claim 6 wherein the one or more retaining bumps are adapted to store a skateboard.

8. The sports equipment storage rack of claim 1 wherein the contained storage area comprises a plurality of panels engageable with one another and adapted to define an area around the plurality or risers.

9. The sports equipment storage rack of claim 1 wherein the upper shelf includes one or more crown features provided extending upward from each of the one or more sockets and adapted to hang one or more items.

10. The sports equipment storage rack of claim 1 wherein the lower shelf includes a recessed area for placing items therein.

11. The sports equipment storage rack of claim 1 further including a plurality of retainers for supporting the contained storage area.

12. The sports equipment storage rack of claim 11 wherein each of the plurality of risers are comprised of at least a first and a second section, and the plurality of retainers being disposed there between.

13. The sports equipment storage rack of claim 11 wherein the contained storage area includes a plurality of loops engaged with the retainers.

14. The sports equipment storage rack of claim 1 wherein the contained storage area is a selectively removable bag.

15. The sports equipment storage rack of claim 14 wherein the selectively removable bag includes a handle.

16. The sports equipment storage rack of claim 14 wherein the selectively removable bag includes a closing mechanism.

17. A sports equipment storage rack comprising:

an upper shelf including, at least one slot for resting elongate items, at least one hook for hanging items, and a plurality of sockets;

a lower shelf including, one or more retaining portions for securing the elongate items in the slots and a plurality of sockets;

a plurality of risers having a first and a second end, wherein the risers connect the upper shelf and the lower shelf; and a selectively removable bag located between the upper shelf and the lower shelf.

18. The sports equipment storage rack of claim 17 wherein one or more of the components are manufactured from one of a polyethylene, polypropylene, and polystyrene material.

19. The sports equipment storage rack of claim 17 wherein the at least one slot and the at least one hook are part of a hook/holder which further includes a cavity thereby creating at least a portion of the at least one hook.

20. The sports equipment storage rack of claim 19 wherein the hook/holder includes at least one cupped recess.

21. The sports equipment storage rack of claim 17 wherein the upper shelf includes a recessed area for placing items therein.

22. The sports equipment storage rack of claim 17 wherein the upper shelf includes one or more retaining bumps projecting upward from a surface of the upper shelf.

23. The sports equipment storage rack of claim 22 wherein the one or more retaining bumps are adapted to store a skateboard.

24. The sports equipment storage rack of claim 17 wherein the upper shelf includes one or more crown features provided extending upward from each of the one or more sockets and adapted to hang one or more items.

25. The sports equipment storage rack of claim 17 wherein the lower shelf includes a recessed area for placing items therein.

26. The sports equipment storage rack of claim 17 further including a plurality of retainers for supporting the contained storage area.

27. The sports equipment storage rack of claim 26 wherein each of the plurality of risers are comprised of at least a first and a second section, and the plurality of retainers being disposed there between.

28. The sports equipment storage rack of claim 17 wherein the selectively removable bag further includes a plurality of loops.

29. The sports equipment storage rack of claim 17 wherein the selectively removable bag includes a handle.

30. The sports equipment storage rack of claim 17 wherein the selectively removable bag includes a closing mechanism.

31. A sports equipment storage rack comprising:

an upper shelf including, a recessed area for placing items therein, a plurality of sockets, and one or more hook/holder portions having at least one slot for resting elongate items, at least one hook for hanging items, a cavity and at least one cupped recess;

a lower shelf including, one or more retaining portions for securing the elongate items in the slots, a plurality of sockets, and a recessed area;

a plurality of risers having a first and a second end, wherein the risers connect the upper shelf and the lower shelf; and a contained storage area.

32. The sports equipment storage rack of claim 31 wherein one or more of the components are manufactured from one of a polyethylene, polypropylene, and polystyrene material.

33. The sports equipment storage rack of claim 31 wherein the upper shelf includes one or more retaining bumps projecting upward from a surface of the upper shelf.

34. The sports equipment storage rack of claim 33 wherein the one or more retaining bumps are adapted to store a skateboard.

35. The sports equipment storage rack of claim 31 wherein the contained storage area comprises a plurality of panels engageable with one another and adapted to define an area around the plurality or risers.

36. The sports equipment storage rack of claim 31 wherein the upper shelf includes one or more crown features provided extending upward from each of the one or more sockets and adapted to hang one or more items.

37. The sports equipment storage rack of claim 31 further including a plurality of retainers for supporting the contained storage area.

38. The sports equipment storage rack of claim 37 wherein each of the plurality of risers are comprised of at least a first and a second section, and the plurality of retainers being disposed there between.

39. The sports equipment storage rack of claim 37 wherein the contained storage area includes a plurality of loops engaged with the retainers.

40. The sports equipment storage rack of claim 31 wherein the contained storage area is a selectively removable bag.

41. The sports equipment storage rack of claim 40 wherein the selectively removable bag includes a handle.

42. The sports equipment storage rack of claim 40 wherein the selectively removable bag includes a closing mechanism.

* * * * *